US007404698B2

(12) United States Patent
Jansen

(10) Patent No.: US 7,404,698 B2
(45) Date of Patent: Jul. 29, 2008

(54) TURBOMOLECULAR PUMP WITH STATIC CHARGE CONTROL

(75) Inventor: Frank Jansen, San Jose, CA (US)

(73) Assignee: Edwards Vacuum, Inc., Wilmington, MA (US)

( * ) Notice: Subject to any disclaimer, the term of this patent is extended or adjusted under 35 U.S.C. 154(b) by 541 days.

(21) Appl. No.: 11/204,615

(22) Filed: Aug. 16, 2005

(65) Prior Publication Data

US 2007/0041826 A1 Feb. 22, 2007

(51) Int. Cl.
*F01D 1/36* (2006.01)

(52) U.S. Cl. ..... 415/90; 415/232; 417/423.4

(58) Field of Classification Search ..... None
See application file for complete search history.

(56) References Cited

U.S. PATENT DOCUMENTS 6,224,326 B1 * 5/2001 Puech ..... 415/90

OTHER PUBLICATIONS

PCT Notification of Transmittal of the International Search Report and the Written Opinion of the International Searching Authority, or the Declaration of the International Application No. PCT/US06/32083; Date of mailing: May 2, 2008.

PCT International Search Report of International Application No. PCT/US06/32083; Date of mailing of the International Search Report: May 2, 2008.

PCT Written Opinion of the International Searching Authority of the International Application No. PCT/US06/32083; Date of Mailing: May 2, 2008.

* cited by examiner

*Primary Examiner*—Richard Edgar
(74) *Attorney, Agent, or Firm*—Ira Lee Zebrak; Mary K. Nicholes

(57) ABSTRACT

The present invention relates to turbomolecular vacuum pumps and an arrangement for reducing or eliminating an accumulated static charge in the rotor caused by an interaction of the rotor with either electrically charged or neutral particles in the pumped media. Electrical charge exchange between the rotor and the electrically grounded stator is effected through a wire or other means of electrical contact, or through charge emission devices such as a field emission tip. In either case, electrostatic charges in the rotor are reduced or eliminated.

10 Claims, 3 Drawing Sheets

TURBOMOLECULAR PUMP WITH STATIC CHARGE CONTROL

FIELD OF THE INVENTION

The present invention relates generally to the field of vacuum pumping, and more particularly, to controlling static charge buildup in a momentum transfer or turbomolecular pump having an otherwise ungrounded rotor.

BACKGROUND OF THE INVENTION

Certain research and manufacturing processes require the use of a process chamber with high vacuum. For example, in semiconductor wafer processing, vacuum is used during many thin-film deposition and etching operations, primarily to reduce contamination. In such processes, pumps capable of producing a "high vacuum" of $10^{-6}$ Torr or lower are useful to assure adequate pumping speed at process pressure, and to allow for a low base pressure for cleanup between steps.

Several currently-available vacuum pump configurations are capable of producing and maintaining a high vacuum. One design, the turbo-molecular vacuum pump, is frequently used in both manufacturing processes and in research instrumentation. A conventional stage arrangement of a turbo-molecular vacuum pump includes a stack of alternate rotors and stators. Each stage effectively comprises a solid disc with a plurality of blades depending (nominally) radially inwardly or outwardly therefrom. The blades are evenly spaced around the circumference of the disc and angled "about" radial lines out of the plane of the disc in the direction of rotation of the rotor stage.

The turbo-molecular vacuum pump is inefficient or inoperable outside the molecular flow realm. For that reason, a commercially available vacuum pump may contain, in addition to several turbo-molecular stages, one or more molecular drag stages and one or more regenerative stages placed between the turbo-molecular stages and the pump outlet.

Turbopump rotors are frequently designed with partial or full magnetic levitation bearings. In certain instances, ceramic or other contact bearings are provided on the fore-vacuum side, and radially stabilizing permanent magnetic bearings are provided on the high-vacuum side. In certain high-vacuum applications, full magnetic levitation bearings are used to suspend the rotor. In those cases, the radial position may be regulated via a permanent magnet stabilizer, or may be regulated electronically. Electromagnets are also used to maintain the axial position of the rotor.

The level of vibration of the rotor in such a case is very low because there is no direct contact with the casing. Further, the rotor may be automatically compensated for out-of-balance vibration, reducing vibration of such rotors by a factor of 10 as compared with a similar rotor supported by ball bearings.

Other advantages of magnetic levitation bearings as compared with mechanical bearings are the absence of oil on the fore-vacuum side, and the lack of wear and resulting maintenance. For all the above reasons, magnetic levitation bearings are the suspension of choice in turbomolecular pumps designed for high and ultra-high vacuum applications.

Strong circumstantial evidence suggests that magnetically levitated rotors in turbomolecular pumps can acquire very high potentials through charge accumulation. The origin of the charge is most likely negatively charged process plasma dust. This dust exchanges its charge upon collision with the rotor, where every collision contributes an incremental amount of charge to the rotor. The rotor is thus charged to high electrical potentials. The electric field associated with the electrically charged rotor exerts a repelling force on dust particles which are caught in the non-uniform electric field at the inlet of the turbo pump to form a particle cloud. These particles may create device defects and decrease the process yield.

An additional contribution to the charge on the rotor may come from tribocharging. Tribocharging is the result of a charge exchange process when dissimilar materials come in contact with each other. For example, a person accumulates charges on the body by walking across a carpet. When contact is made with a grounded item, a discharge occurs, giving the person a shock. In the case of a Mars lander, particles in a dust storm have been known to cause an exchange of electrons, resulting in charge buildup. The amount of charge accumulation depends on the nature of the two materials that come into contact with each other and their ability to dissipate charge.

While a charged conductor distributes charges throughout the body, a charged dielectric maintains local charge distributions. In each case, the primary condition for accumulating charge is that one material is insulated from another, thus preventing recombination of the charges.

As discussed above, the rotor of a turbo-molecular pump is often magnetically levitated, and thus electrically isolated from the surrounding, grounded stator. Even pumps without magnetic levitation often have rotors suspended by ceramic bearings, also insulating the rotor from ground. Given a flow of non-ionized gas over the rotor, a static charge might accumulate on the rotor of the turbo-molecular pump during operation due to tribocharging. The materials that are present (gas species and turbo-molecular pump rotor material) and the absence of a conducting path between the charges will determine the amount of accumulated charge.

Additionally, pumping of ionized gases and dusty plasma also results in charge accumulation. Ions and charged particles contribute to the charge accumulation on the rotor by transferring their charge upon collision. The net charge on the rotor is the result of all these processes.

The build-up of a sufficiently high net charge on the rotor will result in a sudden discharge. The voltage at which discharge occurs depends on the amount of accumulated charge, the pressure, and the distance between the two oppositely charged surfaces.

Plasma physics theory explains the discharge of accumulated charge as the onset of self-ionizing electron flow triggered by an ionizing event. Self-ionizing electron flow is triggered when one electron flows, initiating the release of further electrons through impact with another atom, creating a cascade of electron release. The resultant positive ions then reinitiate further electron flow when they impact the electrodes holding accumulated charge. The onset of self-ionizing electron flow depends on the gas species, the materials that are holding the charge, the pressure, and the distance between the two materials.

Paschen studied the phenomenon of breakdown voltage through a series of experiments in which a pair of electrodes were placed in a vacuum. A voltage was applied to the electrodes. The voltage at the point of breakdown was measured. Paschen found that the breakdown voltage depends on the gas species, the distance between the electrodes, the material of the electrode, the shape of the electrodes and the pressure of the gas. A series of curves were thereby developed for a combination of materials and conditions. Townsend's equations provide for a numerical calculation of the breakdown voltage once certain parameters of the gas species and electrode materials are known.

A typical Paschen curve 110 for tungsten conductors in argon gas is shown in the plot 100 of FIG. 1. A breakdown voltage 111 is plotted against a product of pressure and gap width 112. Independent of conductor material or gas species, Paschen curves have a similar shape in which the breakdown voltage will be minimum at some intermediate pressure-distance product. From the graph of FIG. 1, for a 0.3 mm gap the minimum voltage will be approximately 115 V at a pressure of 16 Torr. For nitrogen, the minimum voltage would be closer to 250 V.

All Paschen curves have a minimum breakdown voltage for a certain pressure-distance combination. Considering a fixed gap, pressures below the minimum voltage point will result in an exponentially rising breakdown voltage approaching infinity. Thus, the system exhibits signs of a perfect vacuum. Pressures greater than the minimum voltage point result in ever increasing breakdown voltages. The converse is also true. However, in interpretation of a fixed pressure with variable distance, the graph should be interpreted only in the case where the distance is large and decreasing.

Turbomolecular pump rotors are operated under conditions wherein a gap or insulating ceramic bearings are present between the rotor and ground, electrically isolating the rotor. Relative movement between the rotor and particles in the pump results in charging which, as noted above, can contribute to several problems including trapping particle dust. There is therefore presently a need to provide an improved turbo-molecular pump incorporating a solution to the problem of accumulating charges on the rotor during operation. To the inventor's knowledge, no such pump is presently available.

SUMMARY OF THE INVENTION

The present invention addresses the needs described above by providing a turbo-molecular vacuum pump that includes a pump housing, a turbo-molecular pump rotor mounted for rotation in the housing, an insulating bearing system that supports the rotor for rotation and electrically insulates the rotor from the housing, and a charged particle source which produces charged particles that cause a decrease of the static electrical charge of the rotor.

The charged particle source may be a field emission tip device, or an array of field emission tip devices. The insulating bearing system may include a magnetic levitation bearing system, and may include a ceramic bearing system. The charged particle source may be located at a high pressure end of the rotor.

Another aspect of the invention is a turbo-molecular vacuum exhaust pump that includes a pump housing, a turbomolecular pump rotor mounted for rotation in the housing, an insulating bearing system that supports the rotor for rotation and electrically insulates the rotor from the housing, and a grounded conductor in contact with the rotor for discharging a static charge of the rotor.

The grounded conductor may be in contact with a high pressure end of the rotor. The grounded conductor may be a grounded wire, and may be a spring-loaded contact. The grounded conductor may be in substantially continuous contact with the rotor.

As in the previous embodiment, the insulating bearing system may include a magnetic levitation bearing system and may include a ceramic bearing system. The grounded conductor may be in contact with a portion of the rotor substantially on an axis of rotation of the rotor.

In a further aspect of the invention, a turbo-molecular vacuum pump is provided, including a pump housing, a turbomolecular pump rotor mounted for rotation in the housing, an insulating bearing system that supports the rotor for rotation and electrically insulates the rotor from the housing, and a rotor static charge discharger for reducing a static electrical charge of the rotor.

The rotor static charge discharger may be a grounding wire attached to the housing and positioned to maintain electrical contact with the rotor. The rotor static charge discharger may alternatively be a charged particle source positioned to direct charged particles of the opposite polarity toward the rotor. The rotor static charge discharger may also be a charged particle source positioned to direct charged particles of the same polarity away from the rotor.

DETAILED DESCRIPTION OF THE INVENTION

Figure 1:
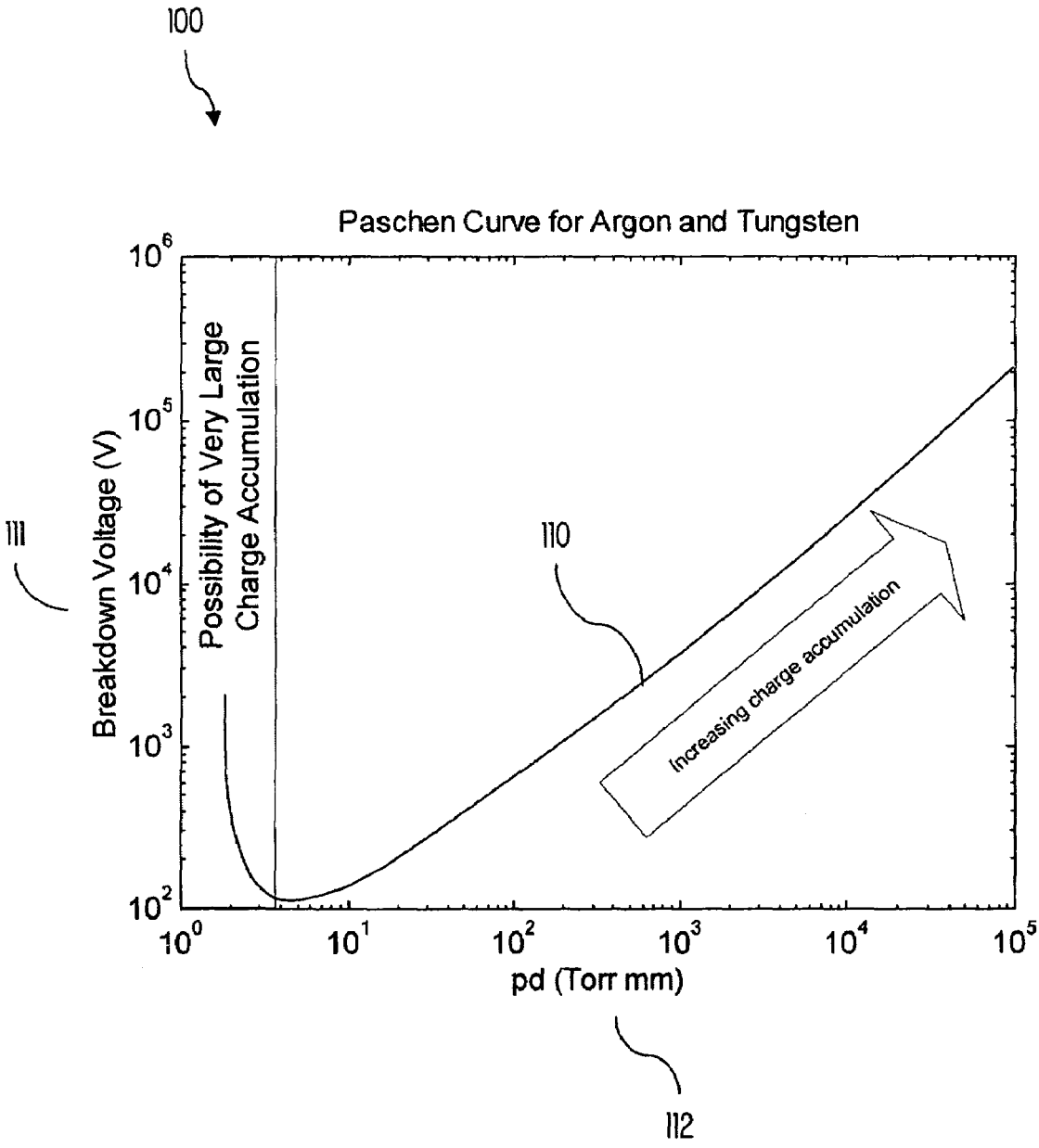
FIG. 1 is a graph showing a Paschen curve plotting breakdown voltage against a product of pressure and gap distance, for tungsten electrodes in argon gas.

According to the present invention, a turbomolecular pump having a magnetically levitated rotor, or a rotor otherwise electrically insulated from the stator, incorporates a mechanism to reduce or control any static charge that might accumulate on the rotor during operation. In a first embodiment of the invention shown in FIG. 2, a stator housing 205 includes a stator 206 and an end cover 203, which are fastened together using fasteners (not shown) as is well known in the art. The stator 206 includes stator blades 207.

Supported for rotation in the stator housing 205 is a rotor 211 fixed to a rotor shaft 210. The rotor 211 includes rotor blades 212 that interact with the stator blades 207 as is known in the art, imparting momentum to gas molecules in a direction from the pump intake 209 to the pump exhaust 208.

The rotor shaft 210 is supported by a pair of magnetic levitation bearings 230, 231 that are pressed into a bore in the housing 205. When activated, the magnetic levitation bearings 230, 231 magnetically maintain an axis of rotation 239 of the rotor shaft 210 in position, without any contact with the housing 205 or the magnetic bearings 230, 231. Simultaneously, axial magnetic levitation bearing 235 maintains the rotor shaft 210 in axial position, also without contact.

An electric motor, shown schematically at 238, provides accelerating and braking torque. Under normal operating conditions, the rotor may rotate at speeds in excess of 30,000 RPM to 40,000 RPM, depending on pump size.

Figure 2:
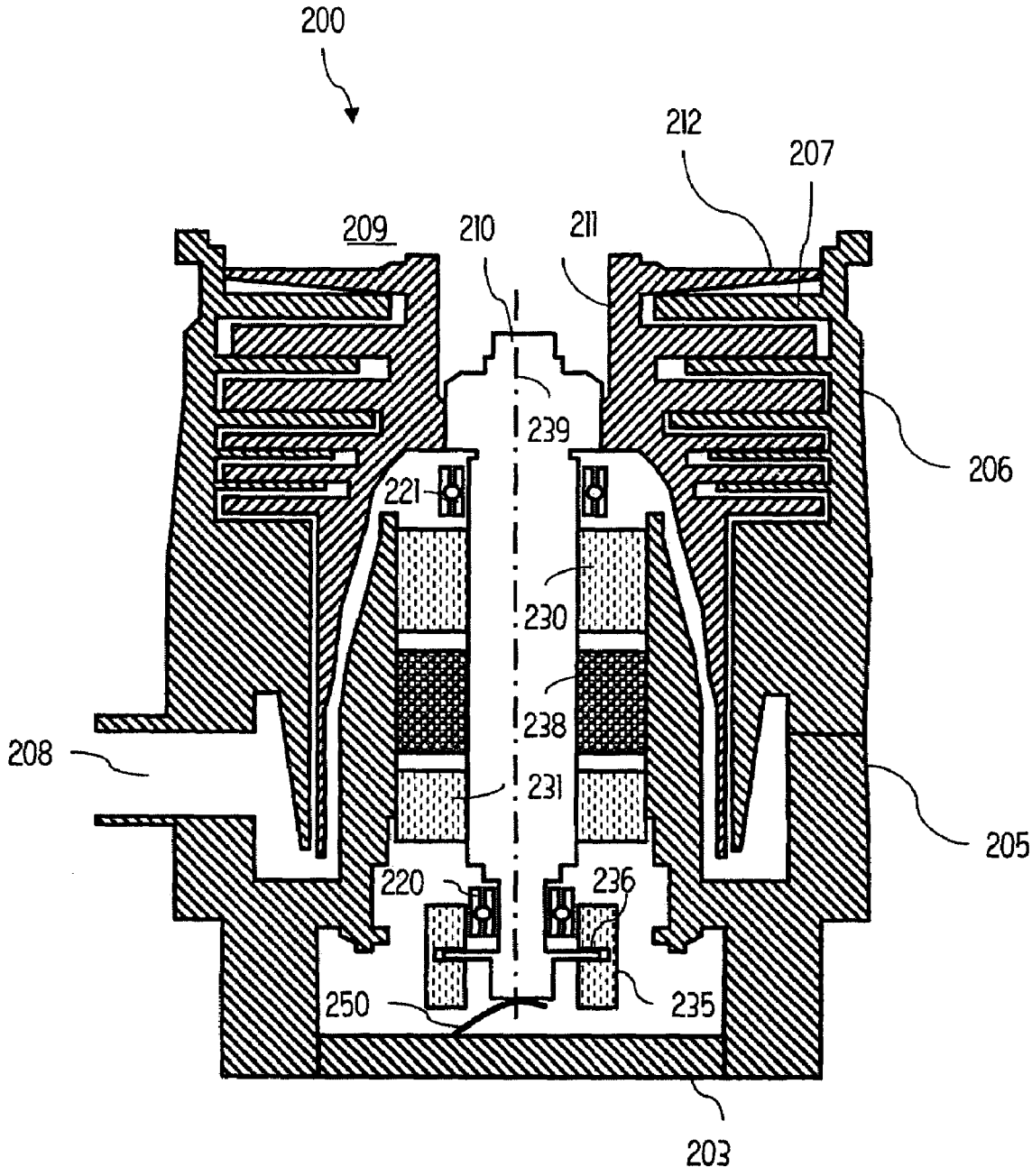
FIG. 2 is a schematic sectional view of a turbomolecular pump according to one embodiment of the invention.

Backup bearings, such as the ball bearings 220, 221 shown in FIG. 2, provide support for the rotor shaft 210 in the stator housing 205 in the event of a failure of the magnetic levitation bearings 230, 231, 235 or a failure of the associated power supply. The backup bearings 220, 221 also provide some support for the shaft 210 during startup and stopping of the pump. The backup bearings 230, 231, 235 do not create an electrical path from the rotor shaft 210 to the stator housing 205 during normal operation of the pump 200, because the rotor 210 is maintained suspended without contact with those bearings.

In the embodiment shown in FIG. 2, an electrically grounded wire 250 is mounted to the stator end cover 203 and is in continuous contact with the rotor shaft 210. The wire may be mechanically biased against the rotor shaft 210 to maintain contact between the wire and the rotor shaft after one or the other has worn. The wire furthermore is constructed of a high-hardness material to minimize wear, such as a spring steel wire that has been flame-hardened in the area of contact.

A contact force between the wire 250 and the rotor shaft 210 should be minimized to further reduce wear, and to avoid excessively biasing the rotor against the magnetic levitation forces exerted by the axial bearing 235. The contact force must, however, be sufficient to assure electrical continuity at least intermittently between the wire 250 and rotor shaft 210.

The contact point of the wire 250 with the rotor shaft 210 is at or near the axis of rotation 239 of the rotor. In that way, the surface speed of the rotor relative to the contact point on the wire is minimized, reducing wear.

The wire 250 may alternatively be positioned to contact the rotor shaft in a radial direction (not shown). In that case, as well as in the axial case, two or more contact wires may be positioned in opposing directions to cancel forces on the shaft caused by the bias of the wire.

The wire 250 of the invention provides an electrical ground path for electrostatic charges that would otherwise accumulate on the rotor. Because the rotor is constructed of a conducting material, any generated charge will be distributed about the rotor, and will not accumulate in a local region. The wire 250 provides a path by which the charge will flow to ground without accumulating on the rotor.

Figure 3:
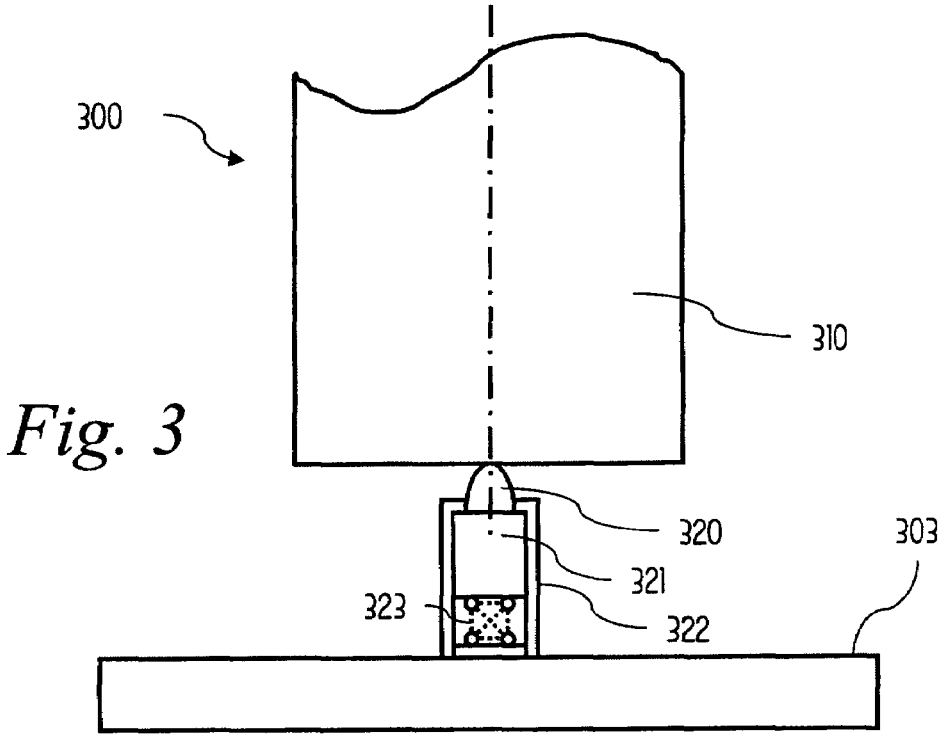
FIG. 3 is a schematic diagram showing a portion of a vacuum pump according to one embodiment of the invention.

A variation of that embodiment of the invention is shown in a detail of a turbomolecular pump 300 of FIG. 3. A rotor 310 rotates relative to a component of a housing such as the end cover 303. On the end cover 303 is mounted an electrical contact 322 including a contact body 321 and a contact tip 320. The contact tip 320 is mechanically biased against the rotor 310 by a spring 323. The tip contacts the rotor 310 at a center of rotation of the rotor in order to minimize relative surface speed and wear.

Like the wire described above, the electrical contact 322 provides a grounding path between the rotor shaft 310 and the housing 303, preventing a buildup of static charge.

Figure 4:
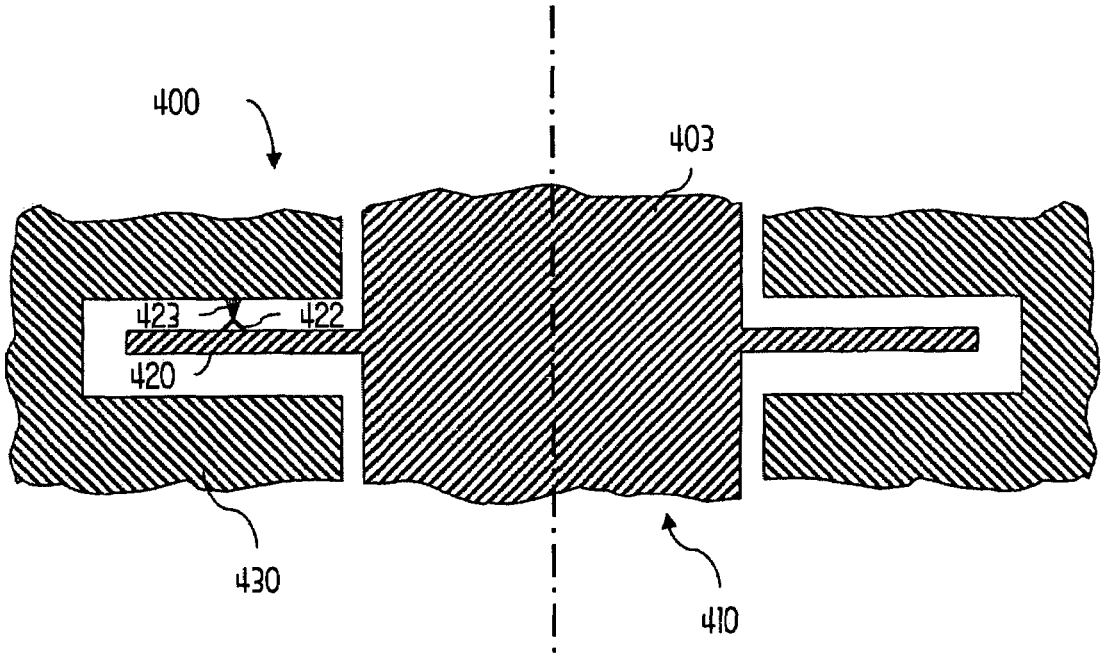
FIG. 4 is a schematic diagram showing a portion of a vacuum pump according to one embodiment of the invention.

In another embodiment 400 of the invention, shown in FIG. 4, a field emission tip device 422 is affixed to the rotor 410. For example, the tip 422 may be integral with a rotor vane 420 that is attached to the central rotor shaft 403. The field emission tip device 422 may include a conical cathode with a tip radius in the range of 10-50 nm. Field emission tip devices may be also be formed using carbon nanotubes. A nanotube is a synthetic molecular carbon structure about one to three nanometers in diameter. Such structures are known to those skilled in the art. In either case, an extremely large electric field gradient, proportional to the sharpness of the tip or the diameter of the nanotube, is formed.

A sufficiently large field gradient causes electrons in the bulk material of the tip to be physically stripped off. The resulting emission phenomenon is referred to as field emission. Once the electrons have escaped the tip, the electrostatic field exerts a force causing the electrons to follow extended trajectories away from the cathode. Following the electric field lines, the electrons that are emitted from the rotor will travel to the stator 430 and disappear to electrical ground.

The flow 423 of electrons from the field emission tip 422 thereby reduces the charge density that would otherwise accumulate on the rotor 410. The field emission tip device 422 is preferably placed at the low vacuum end of the turbomolecular pump where the higher gas pressure may cause an increase in the emission current at lower emission voltage.

The field emission tip or another charged particle source may alternatively be placed on the stator. In such an arrangement, the particle source must be a source of positive charge emanating from the stator. For example, a plasma discharge may be caused in the electric field between the rotor and the stator.

The foregoing Detailed Description is to be understood as being in every respect illustrative and exemplary, but not restrictive, and the scope of the invention disclosed herein is not to be determined from the Description of the Invention, but rather from the Claims as interpreted according to the full breadth permitted by the patent laws. For example, while the system is described in connection with turbomolecular pumps, the system may be used to limit charge accumulation on other devices that utilize magnetic levitation bearings and therefore have otherwise ungrounded rotors. It is to be understood that the embodiments shown and described herein are only illustrative of the principles of the present invention and that various modifications may be implemented by those skilled in the art without departing from the scope and spirit of the invention.

What is claimed is:

1. A turbo-molecular vacuum exhaust pump, comprising:

a pump housing;

a turbo-molecular pump rotor mounted for rotation in the housing;

an insulating bearing system that supports the rotor for rotation and electrically insulates the rotor from the housing; and a charged particle source for providing charged particles that interact with the rotor, thereby reducing a static electrical charge of the rotor and wherein the charged particle source is a carbon nanotube.

2. A turbo-molecular vacuum pump, comprising:

a pump housing;

a turbo-molecular pump rotor mounted for rotation in the housing;

an insulating bearing system that supports the rotor for rotation and electrically insulates the rotor from the housing; and a grounded conductor in contact with the rotor for discharging a static charge of the rotor.

3. The turbo-molecular vacuum exhaust pump of claim 2, wherein the grounded conductor is in contact with a high pressure end of the rotor.

4. The turbo-molecular vacuum exhaust pump of claim 2, wherein the grounded conductor is a grounded wire.

5. The turbo-molecular vacuum exhaust pump of claim 2, wherein the grounded conductor is a spring-loaded contact.

6. The turbo-molecular vacuum exhaust pump of claim 2, wherein the grounded conductor is in substantially continuous contact with the rotor.

7. The turbo-molecular vacuum exhaust pump of claim 2, wherein the insulating bearing system comprises a magnetic levitation bearing system.

8. The turbo-molecular vacuum exhaust pump of claim 2, wherein the insulating bearing system comprises a ceramic bearing system.

9. The turbo-molecular vacuum exhaust pump of claim 2, wherein the grounded conductor is in contact with a portion of the rotor substantially on an axis of rotation of the rotor.

10. A turbo-molecular vacuum pump, comprising:

a pump housing;

a turbomolecular pump rotor mounted for rotation in the housing;

an insulating bearing system that supports the rotor for rotation and electrically insulates the rotor from the housing; and a rotor static charge discharger for reducing a static electrical charge of the rotor, wherein the rotor static charge discharger is a grounding wire attached to the housing and positioned to maintain electrical contact with the rotor.

* * * * *